US005865158A

United States Patent [19]

Cleveland et al.

[11] Patent Number: 5,865,158

[45] Date of Patent: Feb. 2, 1999

[54] METHOD AND SYSTEM FOR CONTROLLING FUEL INJECTOR PULSE WIDTH BASED ON FUEL TEMPERATURE

[75] Inventors: Trent J. Cleveland, Metamora; Thomas J. Crowell, Peoria, both of Ill.

[73] Assignee: Caterpillar Inc., Peoria, Ill.

[21] Appl. No.: 760,091

[22] Filed: Dec. 11, 1996

[51] Int. Cl.[6] ..... F02M 51/00

[52] U.S. Cl. ..... 123/478

[58] Field of Search ..... 123/478, 446, 123/381, 458, 497; 364/160

[56] References Cited

U.S. PATENT DOCUMENTS

| | | | |
|---|---|---|---|
| 4,252,097 | 2/1981 | Hartford et al. | 123/381 |
| 4,357,923 | 11/1982 | Hideg | 123/492 |
| 4,430,978 | 2/1984 | Lewis et al. | 123/478 |
| 4,522,177 | 6/1985 | Kawai et al. | 123/478 |
| 4,545,009 | 10/1985 | Muraki et al. | 364/164 |
| 4,699,109 | 10/1987 | Hensel | 123/458 |
| 5,237,975 | 8/1993 | Betki et al. | 123/497 |
| 5,313,924 | 5/1994 | Regueiro | 123/456 |
| 5,423,302 | 6/1995 | Glassey | 123/446 |
| 5,448,977 | 9/1995 | Smith et al. | 123/478 |
| 5,474,054 | 12/1995 | Povinger et al. | 123/689 |
| 5,551,398 | 9/1996 | Gibson et al. | 123/446 |

FOREIGN PATENT DOCUMENTS 0 420 599 4/1991 European Pat. Off. .

*Primary Examiner*—Raymond A. Nelli
*Attorney, Agent, or Firm*—Robert J. Hampsch

[57] ABSTRACT

A method and system for controlling the injection of fuel across a plurality of fuel injectors coupled together along a fuel rail in an internal combustion engine is provided. The method and system involve producing a reference fuel delivery control signal for each of the fuel injectors as a function of the desired fuel mass to be injected and subsequently adjusting the pulse width of each fuel delivery control signal as a function of the fuel temperature proximate each of the respective fuel injectors. The temperature of the fuel proximate each of the respective fuel injectors along the fuel rail is ascertained by measuring the temperature of the fuel near the inlet of the fuel rail using a temperature sensor and subsequently determining the temperature of the fuel proximate each of the fuel injectors based on the measured fuel temperature measured and the location of said fuel injector along said fuel rail.

13 Claims, 4 Drawing Sheets

METHOD AND SYSTEM FOR CONTROLLING FUEL INJECTOR PULSE WIDTH BASED ON FUEL TEMPERATURE

TECHNICAL FIELD

The present invention relates to a fuel injection system, and more particularly to a fuel injection control system for an internal combustion engine. Still more particularly, the present invention relates to a method and system for adjusting the pulse width or duration of fuel injection based on the fuel temperature proximate each fuel injector.

BACKGROUND OF THE INVENTION

It is well known that the emissions performance of a diesel engine is largely determined by the pressure available to inject fuel into the engine cylinder. As engine emission standards become more stringent, extremely high fuel delivery pressures are required to satisfy the present and future emission regulations. For an engine having a fuel rail to supply the fuel to the injectors, the fuel is typically heated as it passes through the fuel rail which often extends through the cylinder head. Thus, the fuel injector closest to the inlet of the fuel rail typically gets the coolest fuel while the injector located at the distal end of the fuel rail receives fuel at a somewhat elevated temperature.

A prevailing design of fuel injection systems within the industry is to maintain the fuel injection duration, or pulse width of the fuel delivery signal, to be the same for all of the injectors across the fuel rail. However, because of the variation in fuel temperature at each injector, each of the fuel injectors along the fuel rail are subject to differing injection pressures. In other words, since the coolest fuel has a higher density and higher viscosity than the hottest fuel, the injector receiving the coolest fuel requires a higher injection pressure to inject a requisite fuel mass. Conversely, the hottest fuel has a lower density and viscosity, and thus, typically requires a slightly lower injection pressure to inject the predetermined mass of fuel.

Some of the related art devices have attempted to modify the pulse width of the fuel injector based on the desired fuel mass, the measured fuel density, the measured fuel viscosity, or any combination thereof. While it is well established that fuel density and viscosity are more or less related to fuel temperature, the related art devices merely adjust the pulse width for all injectors along a fuel rail by the same amount and do not compensate for the fuel temperature variations at each injector.

For example, U.S. Pat. No. 5,448,977 (Smith et al.) discloses a method for compensating fuel injector pulse width within an internal combustion engine based on the variations in injection pressure and temperature. Specifically, the fuel injector pulse width for all injectors is calculated as a function of desired fuel mass, injector pressure, in addition to the fuel temperature upstream of the fuel rail.

Similarly, U.S. Pat. No. 4,522,177 (Kawai et al.) discloses a temperature compensated fuel injection system that uniformly regulates the fuel supplied to the injectors based on the temperature of the coolant water or fuel. The fuel regulation is preferably accomplished by adjusting the pressure of the fuel supplied to the engine. Alternatively, Kawai et al. teaches that the injection time or pulse width can be adjusted. This pulse width adjustment is uniformly applied to all injectors and is apparently based on air intake quantity (i.e. intake pressures), engine speed, a feedback correction value, water temperature, air temperature, and fuel enrichment factors wherein the fuel enrichment factors are linearly related to fuel temperature.

Other related art devices include U.S. Pat. No. 5,474,054 (Povinger et al.), U.S. Pat. No. 4,252,097 (Hartford et al.), and U.S. Pat. No. 4,430,978 (Lewis et al.) all which disclose a fuel injector system that uniformly adjusts the pulse width of the fuel signal based on a variety of different inputs including a measured fuel temperature.

Disadvantageously, these related art devices do not compensate for the difference in fuel temperature in each of the injectors across the fuel rail. Rather, in the related art fuel injector systems that include a plurality of fuel injectors coupled along the fuel rail, the related art devices maintain a constant pulse width across those fuel injectors. The actual pulse width used in all injectors is based on a variety of different parameters or combinations thereof including desired fuel mass, injector response time, engine exhaust composition, measured pressure difference, average fuel density, or average fuel viscosity.

SUMMARY OF THE INVENTION

The present invention addresses the above and other needs by providing a method for controlling the injection of fuel across a plurality of fuel injectors coupled together along a fuel rail in an electronically-controlled fuel injector system. The disclosed method includes the steps of: (a) generating a fuel delivery control signal for each of the fuel injectors along the fuel rail as a function of the desired fuel mass to be injected; (b) ascertaining the temperature of the fuel proximate each of the fuel injectors along the fuel rail; and (c) adjusting the pulse width of the fuel delivery control signal for each of the injectors in response to the corresponding fuel temperature proximate each of the fuel injectors. Adjusting the pulse width of the fuel delivery signal for each of the fuel injectors is done such that the delivery pressure across any of the plurality of fuel injectors does not exceed a predetermined maximum delivery pressure.

An important aspect of the disclosed invention is revealed in the step of ascertaining the temperature of the fuel near each of the fuel injectors. In the disclosed embodiment, the technique of ascertaining the temperature near each of the fuel injectors is accomplished by measuring the fuel temperature near the inlet of the fuel rail and the outlet of the fuel rail and empirically determining or estimating the temperatures of the fuel near each of the fuel injectors based on the measured fuel temperature and the injector location along the fuel rail.

Another aspect or feature of the disclosed method is realized in the simple yet reliable technique for adjusting the pulse width of the fuel delivery control signal for each of said injectors. The disclosed technique involves first determining a reference pulse width for the fuel delivery control signals as a function of the desired fuel mass to be injected and then determining a pulse width variance for each of the fuel injectors as a function of the fuel temperature measured near the inlet of the fuel rail and the relative location of the fuel injector along the fuel rail. By subsequently adjusting the reference pulse width for each of the fuel delivery control signals by an amount equal to the particular variance for each of the fuel injectors, it is possible to selectively control the fuel delivery pressures for each of the fuel injectors.

A further advantage of the disclosed method is that the step of adjusting the pulse width for each of the fuel injectors can be further controlled such that the adjusted pulse width is less than a predetermined maximum pulse width in order to prevent overfueling of one or more engine cylinders.

The invention may also be characterized as a fuel injector system adapted for delivering fuel to an internal combustion engine. The fuel injector system includes plurality of fuel injectors coupled together along a fuel rail, and a temperature sensor for measuring the fuel temperature near an inlet of the fuel rail. The fuel injector system further includes a fuel system controller adapted for generating a fuel delivery control signal for each of the plurality of fuel injectors as a function of the desired fuel mass to be injected along the entire fuel rail and as a function of the fuel temperature proximate each of the fuel injectors. In particular, the fuel delivery control signals are adjusted so that the pulse width of the fuel delivery control signal for each of the fuel injectors is a function of the temperature of the fuel near the respective fuel injectors.

Advantageously, the disclosed fuel injector system can be tailored to the particular application in which it is used such that the actual delivery pressure in any of the fuel injectors does not exceed a predetermined maximum delivery pressure requirement.

BRIEF DESCRIPTION OF THE DRAWINGS

The above and other aspects, features and advantages of the present invention will be more apparent from the following more particular description thereof, presented in conjunction with the following drawings, wherein.

Corresponding reference numbers indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
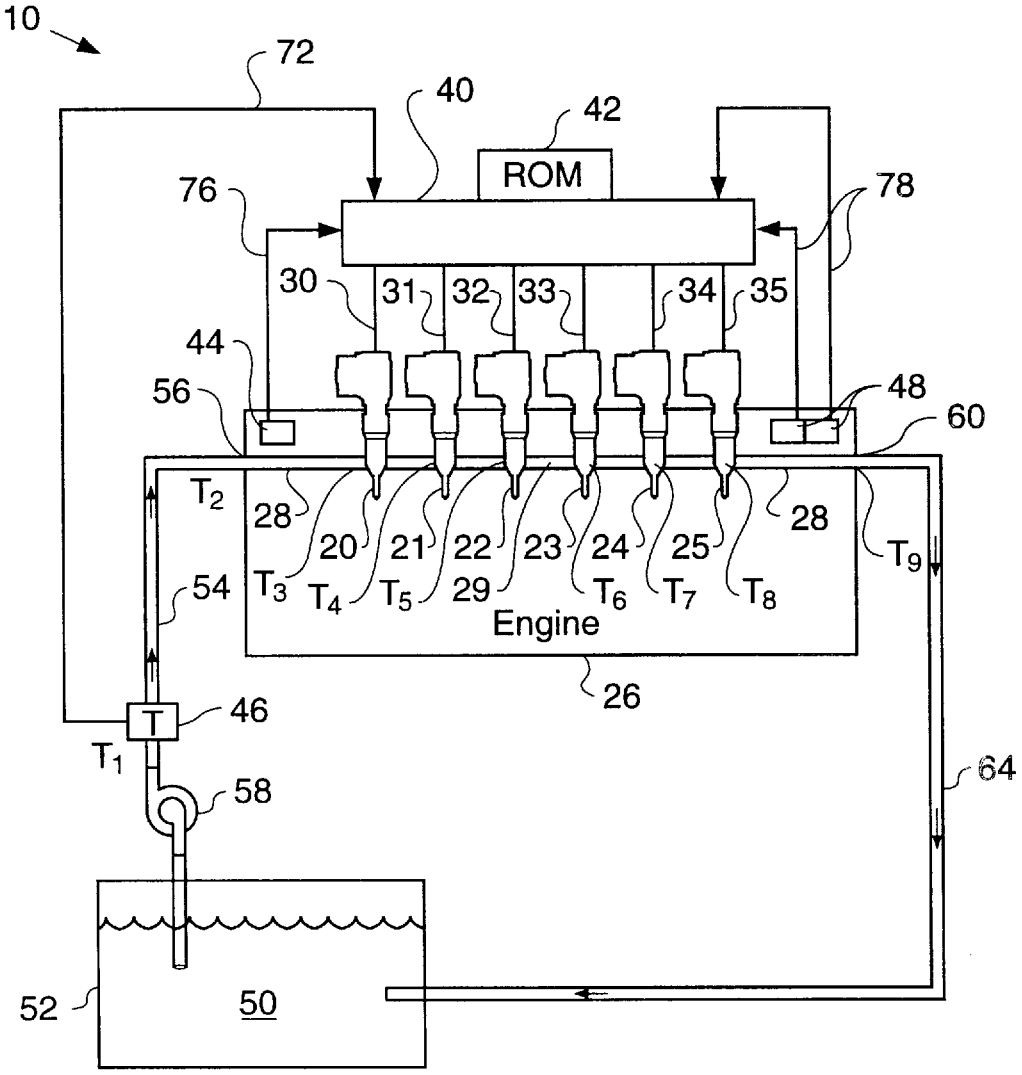
FIG. 1 is a combined block and schematic diagram of a fuel injection system in accordance with the present invention.

Turning first to FIG. 1, there is shown a combined block and schematic diagram of an embodiment of the present fuel injection system. As seen therein, the fuel injection system 10 includes a plurality of electronically-controlled injectors 20, 21, 22, 23, 24, and 25, adapted for injecting fuel into the combustion chamber or cylinder of engine 26. The exemplary engine 26, only partially shown in FIG. 1, may be, for example, a direct injection internal combustion engine (e.g., Caterpillar 3406E diesel engine).

Each of the fuel injectors 20, 21, 22, 23, 24, and 25 is in fluid communication with fuel rail 28 disposed within the engine 26 through which a pressurized supply of fuel 29 passes. As the pressurized supply of fuel 29 passes through the fuel rail 28, fuel delivery control signals 30, 31, 32, 33, 34, and 35 are input to each of the electronically controlled fuel injectors 20, 21, 22, 23, 24, and 25 in a prescribed timing sequence and for a prescribed duration to inject a predetermined quantity of fuel. The fuel delivery control signals 30, 31, 32, 33, 34, and 35 are generated by a controller 40 which determines the prescribed timing and duration thereof in response to various parameters, such as engine speed and other engine operating parameters.

In the embodiment shown, the six fuel injectors 20, 21, 22, 23, 24 and 25 are preferably unit injectors operating under the control of a controller unit. Associated with the controller 40 is a read-only memory (ROM) 42 which contains various data stores used in effectuating said control. As further shown in FIG. 1, the controller 40 of the fuel injection system 10 is also coupled to a sensor for detecting engine speed 44, a temperature sensor 46 for detecting fuel temperature, and various other transducers, sensors, or similar such measurement devices 48 for detecting other engine operating parameters.

Preferably, the sensor for detecting engine speed directly detects the angular speed of the engine crankshaft. Alternatively, the device may detect engine speed by detecting the speed of another engine component, such as a camshaft whose motion is synchronized with the motion of the engine crankshaft. Similarly, the various detectors, sensors or devices for detecting other engine operating parameters include air and water temperature sensors, pressure sensors, transducers, throttle position sensors, load sensors, and similar such measurement devices widely known and used in the control of fuel injection systems.

As indicated above, the plurality of fuel injectors are electronically controlled fuel injector units of the type commonly known and used in the art. For example, the plurality of fuel injectors 20–25 used in the preferred embodiment of the present fuel injection system 10 are substantially the same as the fuel injector disclosed in U.S. Pat. No. 5,551,398.

In the illustrated schematic, the fuel supply 50 originates from a fuel tank 52 or similar such fuel reservoir. A fuel line 54 provides the fluid communication between the fuel tank 52 with the inlet 56 of the fuel rail 28. A prescribed flow rate of the fuel 29 is fed at a generally constant pressure from the fuel tank 52 to the fuel rail 28 within the engine 26 by means of a fuel transfer pump 58. The prescribed fuel flow rate may be determined, for example, by the actual speed of the engine, the desired speed of the engine, operating temperatures of the engine, and other engine operating and control parameters generally known to those persons skilled in the art.

Once within the fuel rail 28 the fuel 29 is then injected into the engine cylinders by one of the fuel injectors disposed along the fuel rail 28. Any excess fuel 29 passing through the fuel rail 28 and not injected into the engine cylinders subsequently exits the fuel rail 28 via an outlet 60 and is preferably returned to the fuel tank 52 or fuel line 54 by way of a return conduit 64.

The present embodiment of the fuel injection system 10 further includes a fuel temperature sensor 46 electronically coupled with the controller 40. The temperature sensor 46 is preferably a thermocouple sensing device placed in operative association with the fuel in the fuel line 54 at a location upstream of the fuel rail 28 so as to measure the temperature of the fuel to be injected into the engine cylinders and generate a corresponding fuel temperature signal 72.

Fuel within the fuel line 28 proximate the temperature sensor 46 has a measured temperature, $T_1$, which is approximately equal to the temperature, $T_2$, at the inlet 56 of the fuel rail 28. As with many conventional designs, however, the fuel rail 28 in the present embodiment extends through the cylinder head thus heating the fuel 29 as it passes through the fuel rail 28. In other words, the fuel injector 20 closest to the inlet 56 of the fuel rail 28 typically receives fuel 29 having a temperature $T_3$ while the fuel injector 25 located at the distal end of the fuel rail 28 receives fuel 29 at what may be a substantially elevated fuel temperature, $T_8$. The fuel 29 proximate each fuel injector interposed between the inlet 56 of the fuel rail 28 and the outlet 60 of the fuel rail 28 generally has a progressively higher temperature. For purposes of describing the present embodiment, it may be helpful to designate the different fuel temperatures throughout the fuel injection system 10. Thus, the temperature of the fuel proximate fuel injector 21 is designated as temperature $T_4$ whereas the temperature of the fuel proximate fuel injector 22 is designated as temperature $T_5$. Likewise, the temperature of the fuel proximate fuel injector 23 is designated as temperature $T_6$, the temperature of the fuel proximate fuel injector 24 is designated as temperature $T_7$ and the fuel temperature at the outlet 60 of the fuel rail 28 is designated as $T_9$. Because the unused fuel exiting the outlet 60 of the fuel rail 28 is returned to the fuel line 54 and presumably mixed with the fuel supply 50 from the fuel tank 52, the measured temperature $T_1$, is continually changing.

It has been found that for a given engine configuration and a given fuel temperature, $T_2$, near the inlet 56 of the fuel rail 28, the temperatures ($T_3$ through $T_8$) of the fuel 29 proximate each of the injectors (20–25) are highly predictable within a given level of accuracy and a given confidence level. It has also been theorized that much of the rise in temperature is attributable to the work performed on the fuel by each of the preceding injectors along the fuel rail 28. Therefore the rise in temperature of the fuel across the injectors is generally a linear function of the inlet temperature $T_2$. In addition, it has also been found that the temperature, $T_1$, of the fuel near the temperature sensor 46 is approximately equal to the fuel temperature, $T_2$, at the inlet 56 of the fuel rail 28. Table 1 shows an example of the fuel temperature profile at an upstream temperature sensor 46 and the estimated temperatures across the fuel rail 28 in a CATERPILLAR 3406E diesel engine, under high speed and high load operating conditions for a variety of upstream fuel temperatures.

Figure 2:
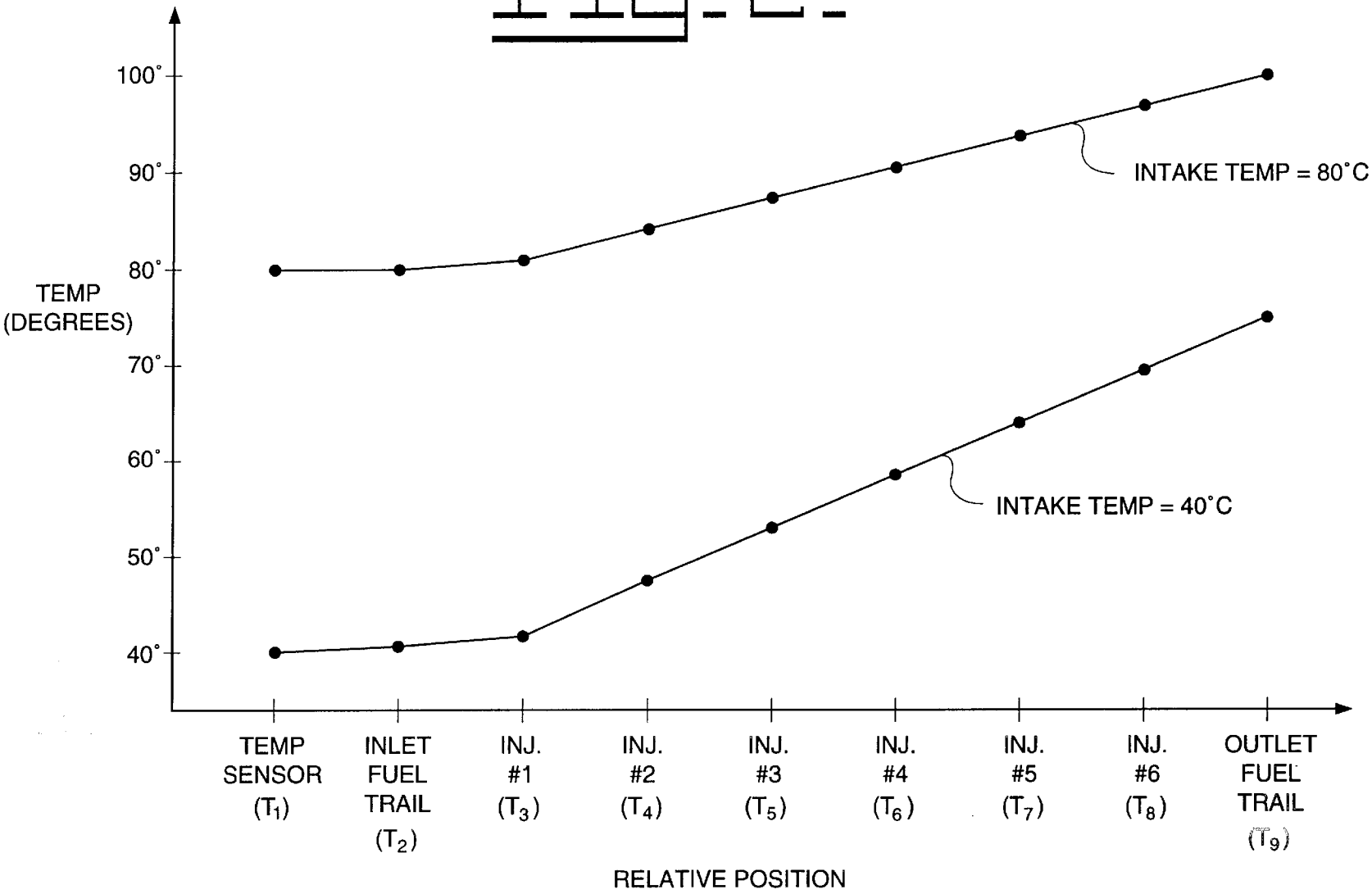
FIG. 2 is a graphical representation of the fuel temperature profile for the fuel injection system of FIG. 1 depicting the differences in fuel temperature proximate each of the fuel injectors for a given fuel rail inlet temperature.

FIG. 2 is a graphical representation of some of the fuel temperature data contained in Table 1 and graphically depicts the differences in fuel temperatures near each of the fuel injectors for a given fuel rail inlet temperature.

Because of the variations in fuel temperature across the six fuel injectors, the delivery pressures at each injector required to inject the prescribed mass of fuel within a prescribed injection duration differed from one injector to the next. (See FIG. 3). This variation in fuel injector delivery pressure is only acceptable so long as the fuel injection delivery pressure on any given fuel injector did not exceed the structural limits of the fuel injectors or a predetermined maximum delivery pressure. Unfortunately, at high load and high speed conditions, the injection, if left unchecked would approach or possibly exceed the maximum fuel delivery pressure. Due to the structural considerations of the fuel injectors, it is desirable to attain the higher injection pressures without raising the predetermined maximum delivery pressure.

The higher injection delivery pressures are typically realized by the fuel injectors receiving the coolest fuel, whereas the lower injection delivery pressures are typically realized by the fuel injectors located at the back end of the fuel rail where the fuel temperature is typically highest. In an effort to reduce the relatively high delivery pressures realized by the fuel injectors at the front end of the fuel rail, the pulse width or duration of the fuel injection cycle is decreased. Concurrently, to prevent overfueling while maintaining the injection pressures that are required to improve the emissions performance of the engines, the pulse width of the fuel delivery control signals for the distal end injectors are only slightly increased.

The relative variations in pulse width or injection duration for each of the fuel injectors is depicted. Specifically, the fuel delivery control signal 30 associated with the first fuel injector 20 on the fuel rail 28 has a pulse width which is approximately 5% shorter than a nominal or reference pulse width. Similarly, the pulse width of the fuel delivery control signal 31 associated with the second fuel injector 21 on the fuel rail 28 (where the fuel temperature, $T_4$, is greater than the fuel temperature, $T_3$, at the first injector) is approximately 3% shorter than a nominal or reference pulse width. As may be expected, the fuel delivery control signal 32 associated with the third fuel injector 22, (where the fuel temperature, $T_5$, is greater than the fuel temperatures $T_3$ and $T_4$) has a pulse width that is approximately 1% shorter than a nominal or reference pulse width. Finally, the fuel delivery control signals 33, 34, 35 associated with the fourth, fifth and sixth fuel injectors 23, 24, 25, each having a progressively higher fuel temperature, $T_6$, $T_7$ and $T_8$ has a pulse width that is approximately 1% longer than a nominal or reference pulse width.

Figure 3:
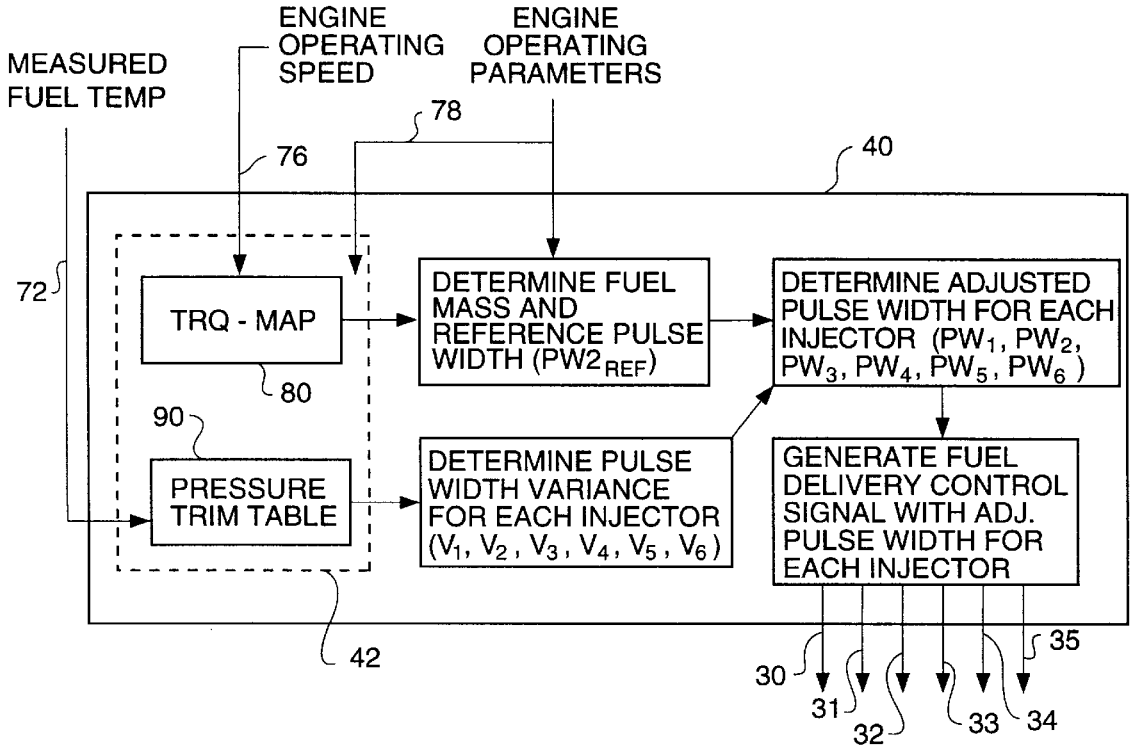
FIG. 3 is a graphical representation of a typical delivery pressure profile depicting the variations in peak delivery pressure at high speed and high load conditions for each of the fuel injectors disposed along a fuel rail when using fuel delivery control signals having a uniform pulse width as compared to the delivery pressure profile for the variable pulse width fuel injection system of FIG. 1.

FIG. 3 shows graphical representations of the delivery pressure profiles across the six fuel injectors (20–25) at the

TABLE 1

Fuel Temperature Data

| | Temperature (°C.) | | | | | | |
|---|---|---|---|---|---|---|---|
| Measured Temp ($T_1$) | 0° C. | 10° C. | 20° C. | 30° C. | 40° C. | 60° C. | 80° C. |
| Fuel Rail Inlet Temp $T_2$) | 0.6 | 0.5 | 20.7 | 31.0 | 40.6 | 60.3 | 80.0 |
| Est. Injector #1 Temp ($T_3$) | 4.0 | 3.0 | 23.0 | 33.0 | 42.0 | 62.0 | 81.0 |
| Est. Injector #2 Temp ($T_4$) | 11.5 | 20.1 | 29.5 | 39.0 | 47.5 | 66.3 | 84.2 |
| Est. Injector #3 Temp ($T_5$) | 18.0 | 27.2 | 36.0 | 45.0 | 53.0 | 70.6 | 87.4 |
| Est. Injector #4 Temp ($T_6$) | 26.5 | 34.3 | 42.5 | 51.0 | 58.5 | 75.0 | 90.5 |
| Est. Injector #5 Temp ($T_7$) | 34.0 | 41.3 | 49.0 | 56.9 | 64.0 | 79.3 | 93.7 |
| Est. Injector #6 Temp ($T_8$) | 41.5 | 48.4 | 55.5 | 62.8 | 69.5 | 83.6 | 96.9 |
| Fuel Rail Outlet ($T_9$) | 49.0 | 55.5 | 62.0 | 68.7 | 75.0 | 88.0 | 100.0 |

high speed, high load condition of a CATERPILLAR 3406E diesel engine when using fuel delivery control signals having a uniform pulse width and when using fuel delivery control signals (30–35) having a variable pulse width as described above. As seen in FIG. 3, by using the variable pulse width fuel injection system 10, it is possible to achieve a mean injection delivery pressure across a plurality of fuel injectors (20–25), each of which is injecting fuel at a different temperature, that is approximately equal to a fuel injection system having a uniform pulse width across all of the injectors. More importantly, the delivery pressure for each of the fuel injectors (20–25) in the variable pulse width fuel injection system 10 is maintained at or below the predetermined maximum delivery pressure, even at high load and high speed conditions.

Figure 4:
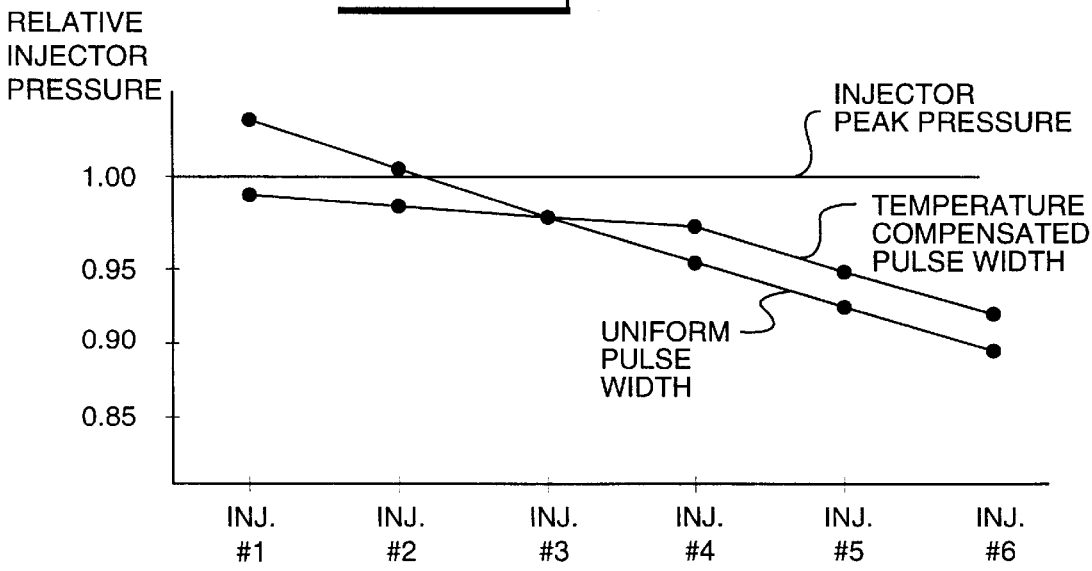
FIG. 4 is a functional block diagram of the present system depicting the functional characteristics of the fuel system controller.

Turning next to FIG. 4, there is shown a functional block diagram of the present system depicting the fuel system controller 40. As shown therein, the fuel system controller 40 is adapted to receive two or more inputs, one of which is a signal 72 indicative of the fuel temperature measurement and one of which is a signal 76 generally indicative of the engine speed. Other input signals 78 generally indicative of other engine operating parameters may also be received by the controller 40. An output of the controller 40 includes the plurality of fuel delivery control signals (30–35), each having a pulse width (i.e. fuel injection duration) that is ascertained based on the fuel temperature near the respective injector (20–25) and may not be uniform for all of the fuel delivery control signals (30–35).

In the depicted embodiment, the engine speed signal 76 is input to the microprocessor based controller 40. A Torque Map 80, resident in a read only memory (ROM) 42 associated with the controller 40, is then accessed to yield a TRQ_LIM parameter based on the engine speed signal 76, as generally depicted in Table 2, below. In particular, Table 2 identifies a portion of a Torque Map for CATERPILLAR 3406E diesel engine. The resulting TRQ_LIM parameter value obtained from the Torque Map 80 is then used by the microprocessor based controller 40 together with other selected engine operating parameters (not shown) to ascertain the quantity of fuel or fuel mass to be injected into each cylinder. The quantity of fuel to be injected determines a reference pulse width 86 used for each of the fuel delivery control signals (30–35).

TABLE 2

| Torque Map | |
|---|---|
| Engine Speed (RPM) | TRQ_LIM (mm) |
| 0 | 5.00 |
| 500 | 4.18 |
| 600 | 4.18 |

TABLE 2-continued

| Torque Map | |
|---|---|
| Engine Speed (RPM) | TRQ_LIM (mm) |
| 700 | 5.26 |
| 800 | 6.13 |
| 900 | 7.35 |
| 1000 | 8.36 |
| 1100 | 8.55 |
| 1200 | 8.80 |
| 1300 | 9.02 |
| 1400 | 9.28 |
| 1500 | 9.59 |
| 1600 | 9.72 |
| 1700 | 9.56 |
| 1800 | 9.43 |
| 1900 | 9.36 |
| 2000 | 9.16 |
| 2100 | 9.01 |
| 3000 | 1.45 |

Concurrently, with the determination of the reference pulse width 86, the temperature sensor signal 72 is also input to the microprocessor based controller 40. The temperature sensor signal 72, which is generally indicative of the temperature of the fuel at the inlet of the fuel rail, is used in conjunction with a Pressure Trim Table 90 or similar such look-up table to determine a pulse width variance for each of the fuel injectors (20–25). The Pressure Trim Table 90, an example of which is shown in Table 3, is also resident in the ROM 42 associated with the controller 40. As indicated above, the pulse width variance for each of the fuel injectors (20–25) is based on the fuel temperature proximate each of the respective injectors which, as seen in Table 3, can be ascertained based solely on the temperature of the fuel at the inlet to the fuel rail for a given engine, which, in turn, is approximately equal to the measured temperature obtained by the temperature sensor. The pulse width variance is preferable expressed as a percentage change required in the TRQ_LIM parameter value (See Table 2), and also includes a positive or negative sign indicative of percentage increase or percentage decrease, respectively. As is well known in the art, entry values (e.g. fuel temperature and engine speed) not expressly provided in the look-up tables can be estimated by applying appropriate interpolation techniques or other such suitable statistical approximation techniques.

TABLE 3

| Pulse Width Variance | | | |
|---|---|---|---|
| | Inlet Fuel Temp 0°C. | Inlet Fuel Temp 40° C. | Inlet Fuel Temp 80° C. |
| Fuel Injector #1 | −5.0% Variance | −5.0% Variance | −5.0% Variance |
| Fuel Injector #2 | −3.0% Variance | −3.0% Variance | −3.0% Variance |
| Fuel Injector #3 | −1.0% Variance | −1.0% Variance | −1.0% Variance |
| Fuel Injector #4 | +1.0% Variance | +1.0% Variance | +1.0% Variance |
| Euel Injector #5 | +1.0% Variance | +1.0% Variance | +1.0% Variance |
| Fuel Injector #6 | +1.0% Variance | +1.0% Variance | +1.0% Variance |

The reference pulse width and corresponding pulse width variance identified for each of the fuel injectors (20–25) are subsequently used by the controller 40 to determine the actual pulse width for each of the plurality of fuel delivery control signals (30–35). The fuel delivery control signals (30–35) having the non-uniform pulse widths are then generated and forwarded to the individual fuel injectors (20–25) to control the timing and duration of fuel injection. In the depicted embodiment, the TRQ_LIM parameter values and pulse width variances are preferable determined empirically. In fact, the actual values as well as the range of allowable variance for any injector and any predetermined minimums and maximum thresholds is preferably tailored to the particular engine, the anticipated operating environment, and the specific application in which the engine is used.

It is important to note, that while adjusting the pulse width of the fuel delivery control signals based on the temperature of the fuel proximate each injector provides certain aforementioned advantages, there are several concerns that should be addressed. In particular, the pulse width variances should be ascertained so as prevent or at least minimize any overfueling of the distal end fuel injectors. Accordingly, it is contemplated that one could impose a set of predetermined maximum variances allowable for one or more of the fuel injectors regardless of the fuel temperature.

Figure 5:
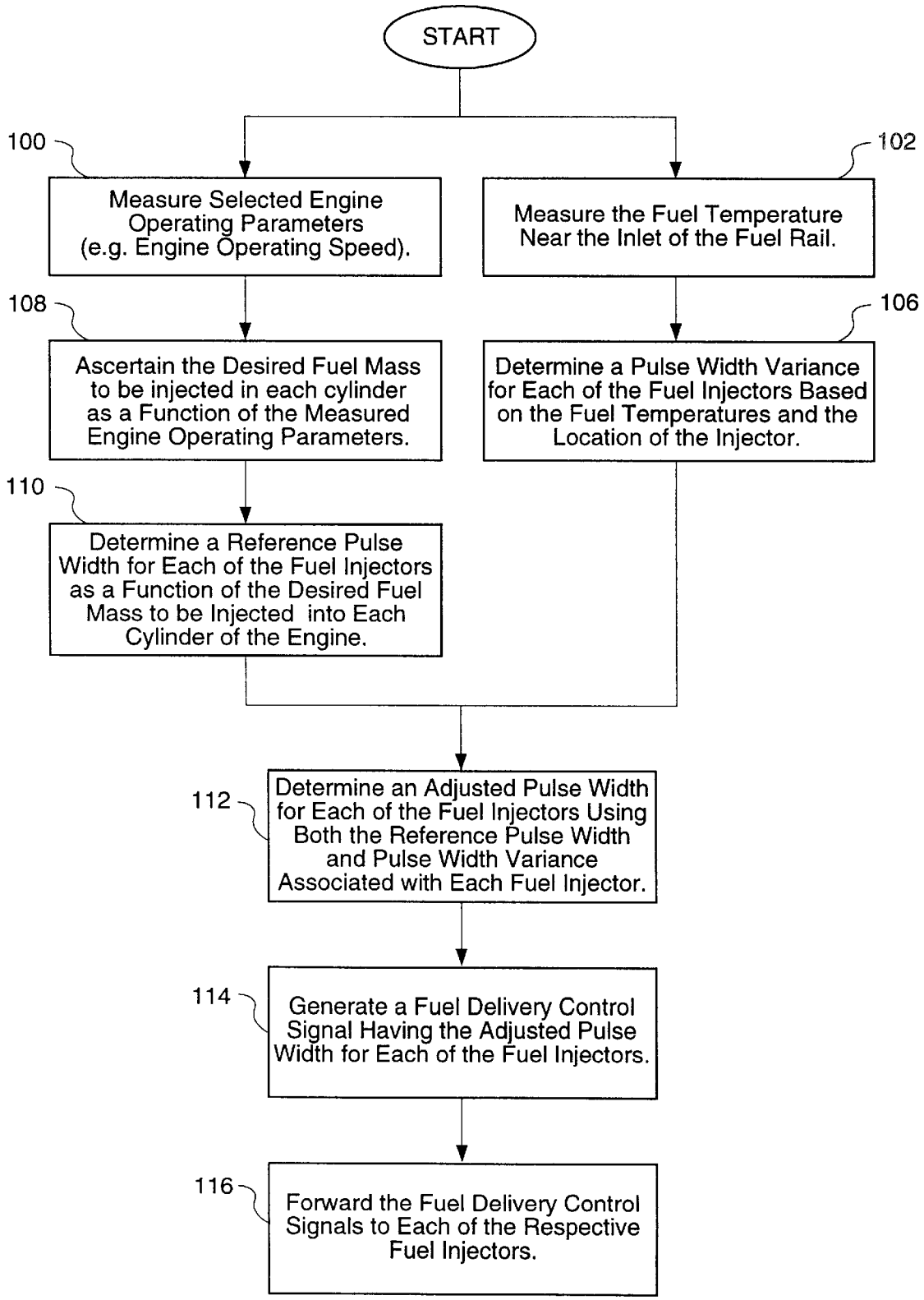
FIG. 5 is a flow chart depicting the various steps involved in the preferred method for controlling fuel injector pulse width based on fuel temperature proximate the fuel injector in accordance with the present invention.

Turning now to FIG. 5, there is shown a flow chart depicting the various steps involved in the preferred method for independently controlling the fuel injector pulse width in a plurality of fuel injectors based on the fuel temperature at or near the fuel injector.

The first step in the presently disclosed method for controlling fuel injector pulse width based on a fuel temperature proximate the fuel injector involves measuring various engine operating parameters including the engine operating speed. (Block 100). Concurrently or sequentially, the fuel temperature near the inlet of the fuel rail is measured using a temperature sensor. (Block 102).

Using selected algorithms and/or look-up tables associated with the fuel system controller, the next step is to determine a pulse width variance for each of the fuel injectors. (Block 106). This pulse width variance is a function of the fuel temperature measured near the inlet of the fuel rail and a relative location of the fuel injector along the fuel rail. Alternatively, one can determine the pulse width variance for each of the fuel injectors as a function of the estimated temperature of the fuel near each of the fuel injectors, if such temperature estimation data is readily available.

Within the above-described process, it is also necessary to ascertain the desired fuel mass to be injected in each cylinder of the engine as a function of the measured engine speed and other engine operating parameters. (Block 108). Having obtained a desired fuel mass to be injected, the next step involves determining a reference pulse width for each of the fuel delivery control signals as a function of the desired fuel mass to be injected into each cylinder of the engine. (Block 110). It is immaterial whether these two steps (Blocks 108 and 110) are performed before, after, or concurrently with the pulse width variance determination steps. (Blocks 104 and 106).

Using both the reference pulse width together with the pulse width variance associated with each individual fuel injector, an adjusted pulse width for each of the fuel injectors is then determined. (Block 112). Such determination is preferably accomplished by adjusting the reference pulse width by an amount equal to said pulse width variance for each of said fuel injectors, being careful, however, not to overfuel the cylinders located at the distal end of the fuel rail.

The next step in the preferred process is to generate a fuel delivery control signal for each of the fuel injectors. (Block 114). Each of the fuel delivery control signals has the adjusted pulse width and an appropriately determined timing sequence. Finally, each of the variable pulse width fuel delivery control signals is then sent to each of the respective fuel injectors thereby effectuating the desired control. (Block 116). The process is repeated for each fuel injection cycle or as often as is deemed appropriate.

From the foregoing, it can be seen that the disclosed invention is a method and system for adjusting the pulse width of a plurality of fuel injectors based on the fuel temperature proximate each injector. While the invention herein disclosed has been described by means of specific embodiments and processes associated therewith, numerous modifications and variations could be made thereto by those skilled in the art without departing from the scope of the invention as set forth in the claims.

What is claimed is:

1. A method for controlling the injection of fuel across a plurality of fuel injectors coupled together along a fuel rail in an electronically controlled fuel injector system, the method comprising the steps of:

(a) generating a fuel delivery control signal for each of said fuel injectors as a function of a desired fuel mass to be injected by each of said fuel injectors;

(b) ascertaining the corresponding temperature of the fuel proximate each of said fuel injectors; and (c) adjusting the pulse width of said fuel delivery control signal for each of said fuel injectors in response to said corresponding fuel temperature proximate each of said fuel injectors such that an actual delivery pressure of each of said fuel injectors does not exceed a maximum delivery pressure.

2. The method of claim 1 wherein the step of ascertaining the temperature of the fuel proximate said fuel injectors further comprises the steps of:

(b1) measuring the fuel temperature near the inlet of said fuel rail; and (b2) determining the temperature of the fuel proximate each of said fuel injectors based on said measured fuel temperature.

3. The method of claim 1 wherein the step of adjusting the pulse width of said fuel delivery control signal for each of said injectors further comprises the steps of:

(c1) determining a reference pulse width for said fuel delivery control signals as a function of the desired fuel mass to be injected;

(c2) determining a variance for each of said fuel injectors as a function of said ascertained fuel temperature and a location of said fuel injector along said fuel rail; and (c3) adjusting said reference pulse width for each of said fuel delivery control signals by an amount equal to said variance for each of said fuel injectors.

4. The method of claim 1 wherein the step of adjusting the pulse width of said fuel delivery control signal for each of said injectors further comprises the steps of:

(c1) determining a reference pulse width as a function of the desired fuel mass to be injected;

(c2) determining a variance for each of said fuel injectors as a function of said ascertained fuel temperature and a location of said fuel injector along said fuel rail; and (c3) determining an adjusted pulse width for each of said fuel injectors by adjusting said reference pulse width by an amount equal to said variance for each of said fuel injectors; and (c4) adjusting the pulse width of each of said fuel delivery control signals such that it corresponds to said adjusted pulse width.

5. The method of claim 1 wherein the step of adjusting the pulse width of said fuel delivery control signal for each of said injectors further includes adjusting the pulse width of said fuel delivery control signal for each of said injectors such that the adjusted pulse width is less than a predetermined maximum pulse width.

6. A fuel injector system adapted for delivering fuel to an internal combustion engine, said fuel injector system comprising:

a plurality of fuel injectors coupled together along a fuel rail;

a temperature sensor for measuring the fuel temperature passing through said fuel injector system; and a controller for generating a fuel delivery control signal for each of said fuel injectors, each of said fuel delivery control signals having a pulse width that is a function of a temperature of the fuel proximate each of said respective fuel injectors, as ascertained using said measured temperature, such that a delivery pressure of each of said fuel injectors does not exceed a predetermined maximum delivery pressure.

7. The fuel injector system of claim 6 wherein said controller is further adapted for determining the temperature of the fuel proximate each of said fuel injectors based on said measured fuel temperature.

8. The fuel injector system of claim 6 wherein the pulse width of the fuel delivery control signals for each of the fuel injectors along said fuel rail are not uniform.

9. The fuel injector system of claim 6 wherein said temperature sensor is adapted for measuring the fuel temperature near an inlet of said fuel rail.

10. The fuel injector system of claim 6 wherein said temperature sensor is located in a fuel line upstream of said fuel rail.

11. The fuel injector system of claim 10 further comprising a return conduit in communication with an outlet of said fuel rail and adapted for returning any unused fuel to said fuel line.

12. The fuel injector system of claim 7 wherein said controller is further adapted for determining a reference pulse width for all of said injectors as a function of engine speed and a pulse width variance for each of said injectors as a function of the location of each of said fuel injectors along said fuel rail and said measured temperature.

13. The fuel injector system of claim 7 wherein said controller is further adapted for determining a reference pulse width for all of said injectors as a function of engine speed and a pulse width variance for each of said injectors as a function of the temperature of the fuel proximate each of said fuel injectors.

* * * * *